US006561064B1

(12) United States Patent
Hada et al.

(10) Patent No.: US 6,561,064 B1
(45) Date of Patent: May 13, 2003

(54) METHOD AND APPARATUS FOR SLITTING A SHEET MATERIAL WEB

(75) Inventors: Frank S. Hada, Appleton, WI (US); Randall J. LeValley, Marysville, WA (US); James M. Perkins, Appleton, WI (US); Lowell E. Thoms, Appleton, WI (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 0 days.

(21) Appl. No.: 09/632,125

(22) Filed: Aug. 3, 2000

Related U.S. Application Data

(63) Continuation of application No. 08/934,346, filed on Sep. 19, 1997, now Pat. No. 6,098,510.

(51) Int. Cl.[7] ..... B65H 35/02

(52) U.S. Cl. ..... 83/13; 83/56; 83/425; 83/478; 83/544; 83/949

(58) Field of Search ..... 83/478, 544, 860, 83/649, 949, 56, 425, 425.2, 425.3, 648

(56) References Cited

U.S. PATENT DOCUMENTS

| | | | | |
|---|---|---|---|---|
| 365,796 | A | 7/1887 | Colley | |
| 480,111 | A | 8/1892 | Manning | |
| 484,173 | A | 10/1892 | Brown | |
| 577,865 | A | 3/1897 | Koegel | |
| 581,377 | A * | 4/1897 | Veeder | 82/93 |

(List continued on next page.)

FOREIGN PATENT DOCUMENTS

| | | |
|---|---|---|
| CA | 649805 | 10/1962 |
| DE | 3040500 A1 | 6/1982 |
| DE | 8600460 U | 2/1986 |
| FR | 1519435 | 3/1968 |
| FR | 2143262 | 2/1973 |
| FR | 2289315 | 5/1976 |
| FR | 2596374 | 10/1987 |
| GB | 814351 | 6/1959 |
| GB | 2122941 A | 1/1984 |
| JP | 354141476 A | 11/1979 |
| WO | WO 86/03445 | 6/1986 |

OTHER PUBLICATIONS

Article—Mannesman Rexroth Star Linear Systems—"Linear Modules MKK . . . with Sealing Strip," (Precision In Motion®, /ra 82 411/10.96) (22pg.).

(List continued on next page.)

*Primary Examiner*—Allan N. Shoap
*Assistant Examiner*—Stephen Choi
(74) *Attorney, Agent, or Firm*—Brinks Hofer Gilson & Lione

(57) ABSTRACT

An apparatus for slitting a sheet material web as it is wound onto a roll including at least one winding drum supporting the web, a moveably reel spool positioned in a parallel and spaced apart relationship with the winding drum, a slitting device and a control system. The slitting device includes a track member and a slitting member moveably mounted on the track member. The slitting member continuously slits the sheet material web longitudinally along its length as it is wound onto the roll. The control system controls the position of the slitting member on the track so as to maintain a predetermined penetration of the slitting member within the roll as the roll increases in size. A method for continuously slitting the roll includes carrying the sheet material web over a winding drum, depositing the sheet material web onto a rotating reel spool to form a roll of sheet material web, moving the slitting member so as to continuously slit the sheet material web on the roll and controlling the movement of the slitting member with a control system so as to maintain a predetermined depth of penetration of the slitting member within the roll.

23 Claims, 9 Drawing Sheets

U.S. PATENT DOCUMENTS

| | | | | | |
|---|---|---|---|---|---|
| 610,329 | A | | 9/1898 | Meisel | |
| 747,544 | A | * | 12/1903 | Fromm | 82/52 |
| 851,015 | A | | 4/1907 | Meisel | |
| 1,026,482 | A | | 5/1912 | White | |
| 1,242,448 | A | * | 10/1917 | Judelshon | 82/91 |
| 1,354,464 | A | | 10/1920 | Cameron et al. | |
| 1,892,058 | A | * | 12/1932 | Judelshon | 269/49 |
| 1,951,140 | A | * | 3/1934 | Fahrney | 82/97 |
| 2,109,057 | A | * | 2/1938 | Billker et al. | 83/478 |
| 2,326,293 | A | * | 8/1943 | Gast | 83/490 |
| 2,457,310 | A | * | 12/1948 | Judelshon | 451/420 |
| 2,521,385 | A | * | 9/1950 | Marion | 82/93 |
| 2,621,736 | A | | 12/1952 | Scruggs et al. | |
| 3,058,685 | A | | 1/1962 | Kistler | |
| 3,148,570 | A | * | 9/1964 | Bogert | 83/803 |
| 3,226,049 | A | | 12/1965 | Corbett | |
| 3,304,020 | A | | 2/1967 | Fleenor | |
| 3,585,980 | A | | 6/1971 | Mellor | |
| 3,977,627 | A | | 8/1976 | Sundin | |
| 4,216,686 | A | * | 8/1980 | Stoffels | 82/98 |
| 4,584,918 | A | * | 4/1986 | Stubbe et al. | 83/471.3 |
| 4,693,150 | A | * | 9/1987 | Barclay et al. | 83/478 |
| 4,695,006 | A | | 9/1987 | Pool | |
| 5,083,489 | A | * | 1/1992 | Tidland et al. | 83/482 |
| 5,125,333 | A | * | 6/1992 | Gourley, III | 83/478 |
| 5,131,304 | A | * | 7/1992 | Paavola | 83/478 |
| 5,383,380 | A | * | 1/1995 | Satori | 82/70.1 |
| 5,531,147 | A | * | 7/1996 | Serban | 83/478 |
| 5,591,309 | A | | 1/1997 | Rugowski et al. | |
| 5,593,545 | A | | 1/1997 | Rugowski et al. | |
| 5,655,583 | A | | 8/1997 | Heintzeman | |
| 5,794,500 | A | | 8/1998 | Long et al. | |
| 6,155,152 | A | * | 12/2000 | Bilstein et al. | 83/478 |

OTHER PUBLICATIONS

Article—"Motion Control Will Never Be The Same"—1394 Digital, AC, Multi–Axis Motion Control System (Rockwell Automation Allen–Bradley—Pub. 1394—1.0—Jan. 1997). (12pg.).

* cited by examiner

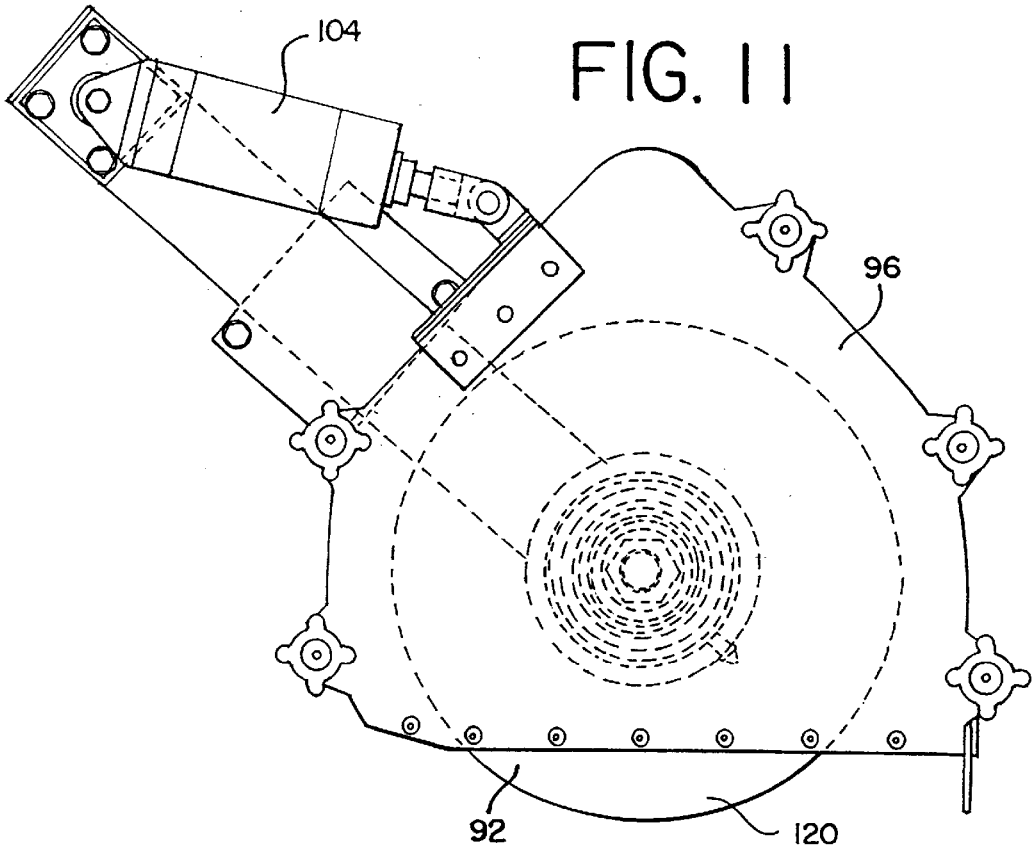
FIG. 11
FIG. 12
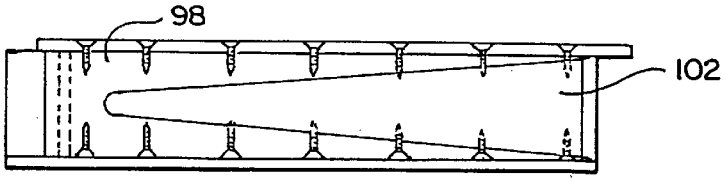
FIG. 13
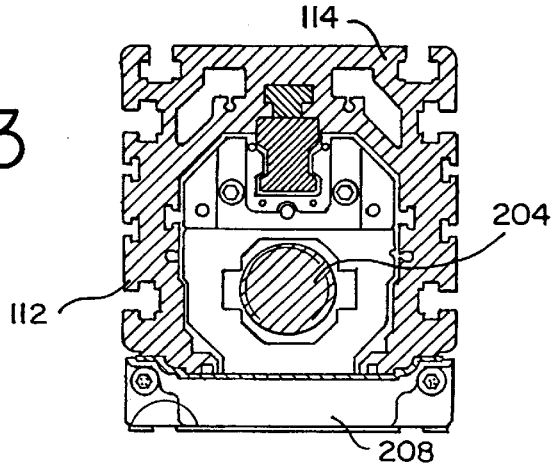

METHOD AND APPARATUS FOR SLITTING A SHEET MATERIAL WEB

This application is a continuation of application Ser. No. 08/934,346, filed Sep. 19, 1997, the entire disclosure of which is hereby incorporated herein by reference.

BACKGROUND OF THE INVENTION

The present invention relates generally to a method and apparatus for slitting a sheet material web, and in particular, to a method and apparatus for slitting a sheet material web being wound on a roll.

It is well known in the field of paper making, and particularly in the field of manufacturing tissue products such as facial tissues, bath tissues and paper towels, to provide an apparatus for longitudinally slitting a continuously running sheet material web into two or more strips. Typically, the sheet material web is slit either as it traverses an "open draw" before being wound into rolls, before it is dried or after it is wound onto the roll. In the first instance, the area of open draw, where the dried sheet is momentarily unsupported before being wound, provides an ideal place to slit the web. In particular, the slitting device, often configured as a rotary saw blade, can be applied to the web without concern about cutting or otherwise damaging an underlying fabric, which otherwise carries the sheet material web throughout the forming process. Fabrics of this nature can be expensive and difficult to replace.

However, as described in U.S. Pat. No. 5,591,309, issued Jan. 7, 1997 to Rugowski et al., and assigned to Kimberly-Clark Corporation, the same assignee as the present application, open draws are a frequent source of sheet breaks and associated production delays. As a result, tissue sheets often are designed to have high machine direction strengths in order to remain intact as they are pulled through the open draw. However, high machine direction strengths can adversely affect the quality of the web in terms of its desired softness. Therefore, as explained in U.S. Pat. No. 5,591,309, the elimination of open draws in tissue manufacturing can result in a sheet material being made more efficiently at less cost and wish more desirable properties.

When the open draw is eliminated, the sheet material web is typically slit using a water jet prior to drying the web. However, such "wet slitting" can result in a degradation of the throughdrying fabric as it is exposed to hot air passing through the slit in the sheet material during the drying stage of the process. Moreover, the slit edges of the sheet material web may not dry evenly due to the pile up of fibers along the slit. Additionally, when the sheet material web is slit prior to drying, the various strips of sheet material web are difficult to control and can become inadvertently interwoven, or overlapped, as they are further carried towards the winding drum and reel spool. Interwoven strips can be more easily damaged and can make the winding process particularly difficult. Moreover, adjacent rolls having interwoven webs can be particularly difficult to separate. Accordingly, the strips of sheet material web are typically required to be spread apart so as to prevent interweaving.

In contrast to slitting the web prior to drying, it is also known in the art to slit the sheet material web as it is wound onto the roll. Slitting apparatuses of this nature typically apply a pressure or guide roller, or like device, to the outermost surface of the roll so as to thereby control the penetration of the slitting device. However, facial and bath tissues typically have relatively low densities, and hence low resistance to compressive forces. Accordingly, it usually is not desirable, or even possible, to allow such a guide roller to contact the roll as it builds so as to thereby control the position of the slitter, and the penetration thereof

SUMMARY OF THE INVENTION

Briefly stated, the invention is directed to an apparatus for slitting a sheet material web as it is wound onto a roll. The apparatus includes a slitting device having a track member and a slitting member moveably mounted on the track member. The slitting device is supported adjacent to a roll of sheet material web. The apparatus includes at least one winding drum which supports the sheet material web and a moveable reel spool which is positioned in a parallel, spaced apart relationship with the winding drum. The sheet material web is deposited on the reel spool which moves away from the winding drum as the diameter of the roll formed thereon increases. A control system connects the track member and reel spool and is adapted to move the slitting member on the track member in relation to the position of the reel spool relative to the at least one winding drum so as to maintain the predetermined depth of penetration of the slitting member within the roll. In this way, the control system controls the depth of penetration of the slitting member within the roll as it increases in size so as to maintain the desired penetration of the slitting member within the roll but without the control system or track contacting an outer surface of the roll.

In one aspect of the invention, the slitting device includes a carriage which is moveably mounted on a laterally extending support member. In operation, the operator can move the carriage laterally along the length of the cross member to alter the position of the slit in the sheet material web, or to provide access to the slitting device.

In a preferred embodiment, the track member is pivotally attached to the support member about a horizontal axis. In operation, the track member can be pivoted about the axis to maintain the penetration of the slitting member within the roll, or to move the slitting device completely out of the path of the roll, reel spool or supporting structure.

In yet another aspect, a method is provided for continuously slitting the sheet material web as it is wound onto a roll. The method includes the steps of carrying the web over a winding drum in a longitudinal direction, depositing the web onto a rotating reel spool to form a roll, making a plunge cut with a slitting member to slit the roll after a predetermined number of initial layers are formed on the roll, moving the reel spool relative to the winding drum as the size of the roll increases and moving the slitting member relative to the position of the reel spool so as to continuously slit the web on the roll while maintaining a predetermined depth of the slitting member within the roll.

The present invention provides significant advantages over other slitting devices. Importantly, the apparatus allows for slitting the sheet material web while it is being wound onto a roll. In this way, the open draw of the forming process can be eliminated so as to reduce waste and improve the quality of the sheet material, but without having to slit the web prior to the drying process, wherein the problems of fabric degradation, fiber build-up at the slit edges and loss of sheet control can be encountered.

Moreover, the apparatus provides for an improved, cleaner cut as compared with webs slit over an open draw because the sheet material web is supported by the underlying layers of web already wound onto the roll. Moreover, since the web is slit as it is wound onto the roll, the problem of interweaving is thereby eliminated, and the rolls can be easily separated.

In addition, the present invention provides an improved method and apparatus for slitting the web on the roll. In particular, the track and control system provide a unique way of maintaining the desired penetration of the blade within the roll without using a guide roller or similar device to contact the outer surface of the roll. This is especially important with the manufacture of tissue rolls wherein the density of the web is relatively low and the roll is less capable of reliably supporting a guide roller. Moreover, bathroom tissue and the like are formed from at relatively fragile sheet material web which can be more easily damaged by contact with a guide roller or similar device.

In addition, since the track and slitting member are not dependent upon or linked to the surface of the roll, and the penetration of the slitting member is not controlled thereby, the penetration of the slitting member can be independently adjusted. In this way, the slitting member can be moved to provide an initial plunge cut in the roll after a predetermined number of initial layers are wound onto the roll, and the depth of the penetration can be easily adjusted to account for varying thicknesses of the sheet material web. The capability to provide a plunge cut through the use of a programmable controller greatly simplifies the mechanism. Moreover, by providing a pivotal attachment, the slitting member can be easily and quickly moved away from the roll if slitting is not desired, in the event of a sheet break or for various other reasons such as avoiding overhead support structure while laterally moving the track above the roll of sheet material.

Additionally, the apparatus can easily be moved laterally to any desired position above the longitudinally moving web, or can be moved completely to the side of the operating line so as to be accessible to the operator for blade changes and the like. Alternatively, a plurality of slitting apparatuses can be positioned above the web so as to enable the operator to make multiple strips of sheet material web. In either situation, the desired slitting operation can be set up quickly, inexpensively and with little or no waste.

Furthermore, the use of a single track overlying the roll eliminates the need for parallel tracks on opposite sides of the roll, and thereby avoids the possibility of binding, within the tracks and reduces the overall cost of making and maintaining the apparatus.

The present invention, together with further objects and advantages, will be best understood by reference to the following detailed description taken in conjunction with the accompanying drawings.

BRIEF DESCRIPTION OF THE DRAWINGS

Many of the features and dimensions portrayed in the drawings, and in particular the presentation of sheet material web thicknesses and the like, have been somewhat exaggerated for the sake of illustration and clarity.

FIG. 11 is an enlarged partial side view of the slitting device.

FIG. 12 is an enlarged bottom view of the guard.

FIG. 13 is a cross sectional view of the track member.

DETAILED DESCRIPTION OF THE PRESENTLY PREFERRED EMBODIMENTS

It should be understood that the term "web," as used herein, is meant to include a sheet material made of one or more plies of material so that a multiple-ply sheet material is considered to be a "web" of sheet material, regardless of the number of plies. In addition, the term "longitudinal," as used herein, is intended to indicate the direction in which the web traverses through the forming process in the machine direction, and is not intended to be limited to a particular length of the web, whether it is cut or otherwise. Similarly, the terms "downwardly,""upwardly,""forward", "rearward", "left" and "right" as used herein are intended to indicate the direction relative to the views presented in the Figures, and in particular, from a perspective when viewing the web and fabric as they travel away from the drier toward the slitting apparatus and ultimately to the reel spool.

Figure 1:
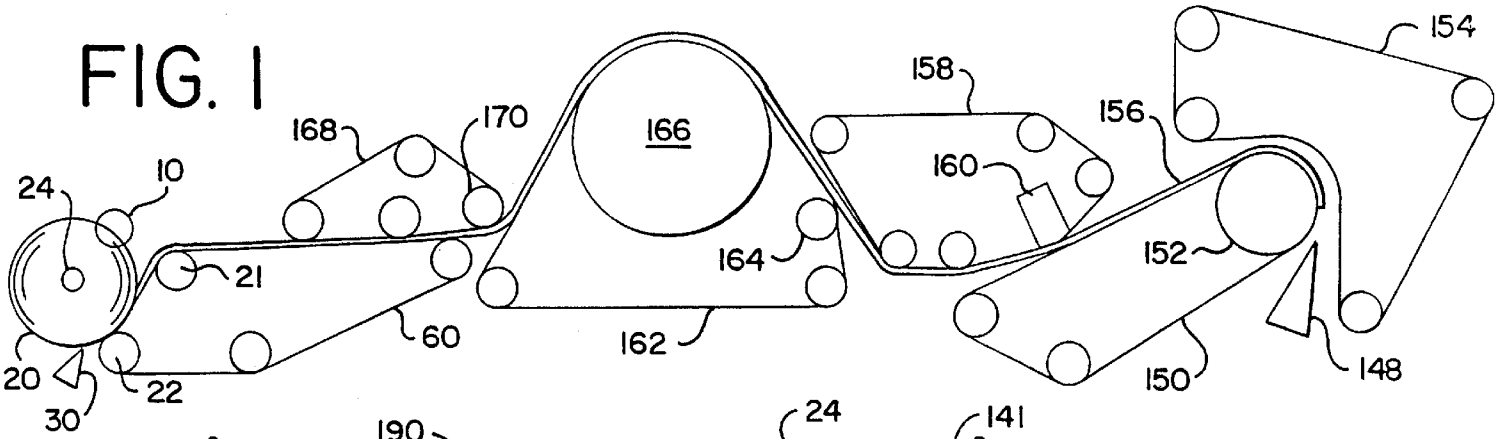
FIG. 1 is a schematic process flow diagram of a method for making soft high bulk tissue sheets in accordance with this invention.

Referring to FIG. 1, a schematic diagram for forming a sheet material web without an open draw is shown. The apparatus and method for making such a web is set forth in U.S. Pat. No. 5,593,545, issued Jan. 14, 1997, U.S. Pat. No. 5,591,309, issued Jan. 7, 1997, and U.S. application Ser. No. 08/887,922, entitled Uniformly Wound Rolls of Soft Tissue Sheets Having High Bulk, filed Jul. 3, 1997, and assigned to Kimberly-Clark Corporation, the assignee of the present application, all of which are herein incorporated by reference. However, it should be understood by one of skill in the art that the present invention could be used with other paper forming processes which utilize fabrics and/or belts to carry a sheet material web, with or without an open draw, and can be used for slitting other types of sheet materials other than paper products.

As explained in U.S. Pat. Nos. 5,593,545 and 5,591,309, and application Ser. No. 08/887,892, and as shown in FIG. 1, a representative through drying process for making uncreped throughdried tissues is shown. Shown is the headbox 148 which deposits an aqueous suspension of papermaking fibers onto inner forming fabric 150 as it traverses the forming roll 152. Outer forming fabric 154 serves to contain the web while it passes over the forming roll and sheds some of the water. The wet web 156 is then transferred from the inner forming fabric to a wet end transfer fabric 158 with the aid of a vacuum transfer shoe 160. This transfer is preferably carried out with the transfer fabric traveling at a slower speed than the forming fabric (rush transfer) to impart stretch into the final sheet material web. The wet web is then transferred to the throughdrying fabric 162 with the assistance of a vacuum transfer roll 164. The throughdrying fabric carries the web over the throughdryer 166, which blows hot air through the web to dry it while preserving bulk. There can be more than one throughdryer in series (not shown), depending on the speed and the dryer capacity. The dried tissue sheet is then transferred to a first dry end transfer fabric 168 with the aid of vacuum transfer roll 170. The sheet material web shortly after transfer is sandwiched between the first dry end transfer fabric and the transfer belt 60, or fabric, to positively control the sheet path. The air permeability of the transfer belt 60 is lower than that of the first dry end transfer fabric, causing the sheet to naturally adhere to the transfer belt. At the point of separation, the sheet follow the transfer belt due to vacuum action. Suitable fabrics for use as the first dry end fabric include without limitation, a wide variety of fabrics such as Asten 934, Asten 939, Albany 59M, Albany Duotex DD207, Lindsay 543 and the like.

After the sheet material web is compressed between the first dry end transfer fabric and the second dry end transfer fabric 60, which, in one embodiment, has a greater air permeability than that of the first dry end transfer fabric, the web is wrapped around the winding drum 21. Suitable low permeability fabrics for use as transfer belts, or fabrics, include, without limitation, COFPA Monocap NP 50 dyer felt (air permeability of about 50 cubic feet per minute per square foot) and Asten 960C (impermeable to air). The transfer belt 60 passes over the two winding drums 21 and 22 before returning to pick up the dried tissue sheet again. The sheet is transferred to the parent roll 20, or building roll, at a point between the two winding drums. Alternatively, as shown in U.S. Pat. Nos. 5,593,545 and 5,591,309, the assembly includes only a single winding drum located adjacent the reel spool. In such an embodiment, the sheet passes through the winding nip between the winding drum and the reel spool and is wound into a roll of tissue for subsequent converting, such as slitting, cutting, folding and/or packaging. In either embodiment, the parent roll is wound onto reel spool 24, which is driven by a motor.

Referring to FIGS. 2–3 and 17–18, the transfer and winding of the sheet is illustrated in more detail. In the free span between the two winding drums 21, 22, the sheet 100 contacts and transfers to the parent roll 20. Reference numbers 24, 24' and 24" illustrate three position of the reel spool during continuous operation with the roll shown in phantom. As shown, a new reel spool 24" is ready to advance to position 24' as the parent roll is building. When the parent roll has reached its final predetermined diameter, the new reel spool is lowered by arm 27 into position 24' against the incoming sheet at some point along the free span between the winding drums, generally relatively close to the first winding drum 21, thereby avoiding a hard nip between the winding drum and the reel spool. The reel spool 24 is supported appropriately by carriages 200, 402. As the parent roll builds, the reel spool 24 moves toward the other winding drum 22 while at the same time moving away from the transfer belt 60.

The reel spool 24 can be moved in either direction as illustrated by the double-ended arrow to maintain the proper transfer belt deflection needed to minimize the variability of the sheet properties during the winding process. As a result, the parent roll nip substantially traverses the free span as the roll builds to its predetermined size, or diameter. At the appropriate time, one or more air jets 30, shown in FIG. 1, serve to blow the sheet back toward the new reel spool 24' in order to attach the sheet to, or deposit it on, the new reel spool by vacuum suction from within the reel spool. As the sheet is transferred to the new reel spool, the sheet is broken and the parent roll is kicked out to continue the winding process with a new reel spool.

As shown in FIGS. 2–3 and 17–18, the reel spool 24 includes a circumferential groove 401 near each end which is rotatably supported on a pair of rails 400. The ends of the reel spool 24 are each operably engaged by a carriage, including a drive carriage 200 and a back carriage 402 which move the reel spool longitudinally along the length of the rails. A support 404, 406 is provided beneath each carriage and supports the carriages with linear bearings 408. A motor 410 is operably connected to a reducer 412, both of which are supported on the drive carriage 200. The reducer 412 includes a retractable gear which extends to operably engage a gear coaxially mounted in the end of the reel spool. In operation, the motor rotates the reducer gear so as to thereby rotate the reel spool. A pair of hydraulic cylinders 202 is mounted to the rail, or similar frame member, and is operably connected to the carriages 200 and 402.

Figure 3:
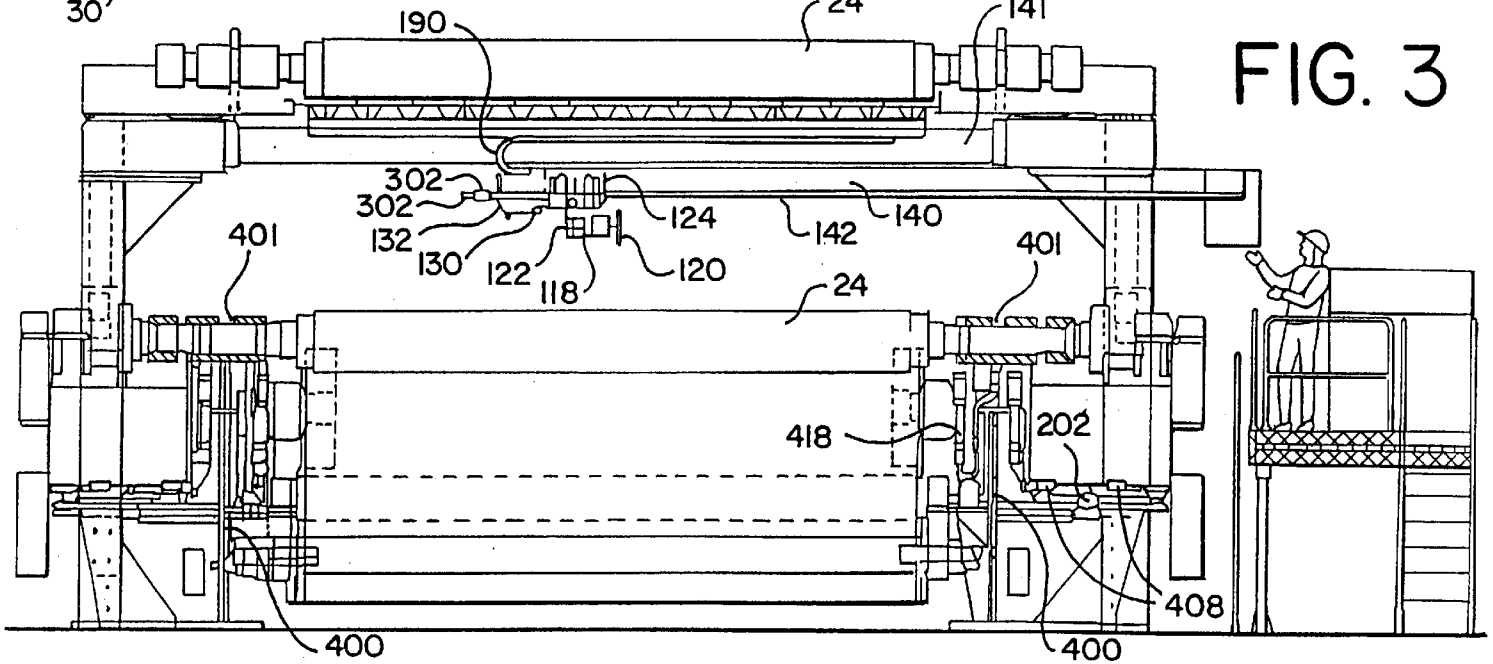
FIG. 3 is a front view of the slitting apparatus shown in FIG. 2.
Figure 17:
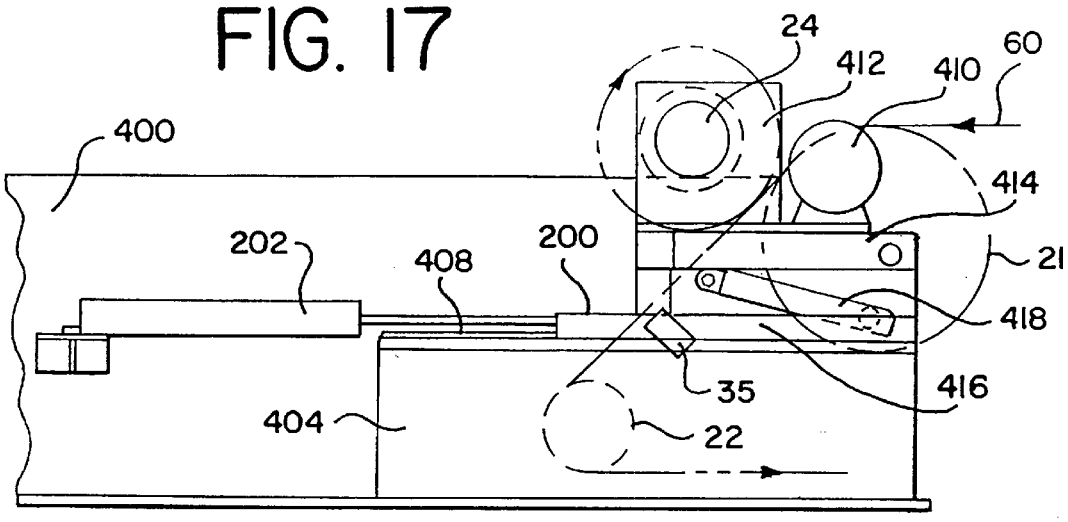
FIG. 17 is a partial side view of the reel spool and winding drum without the slitting device applied thereto.
Figure 18:
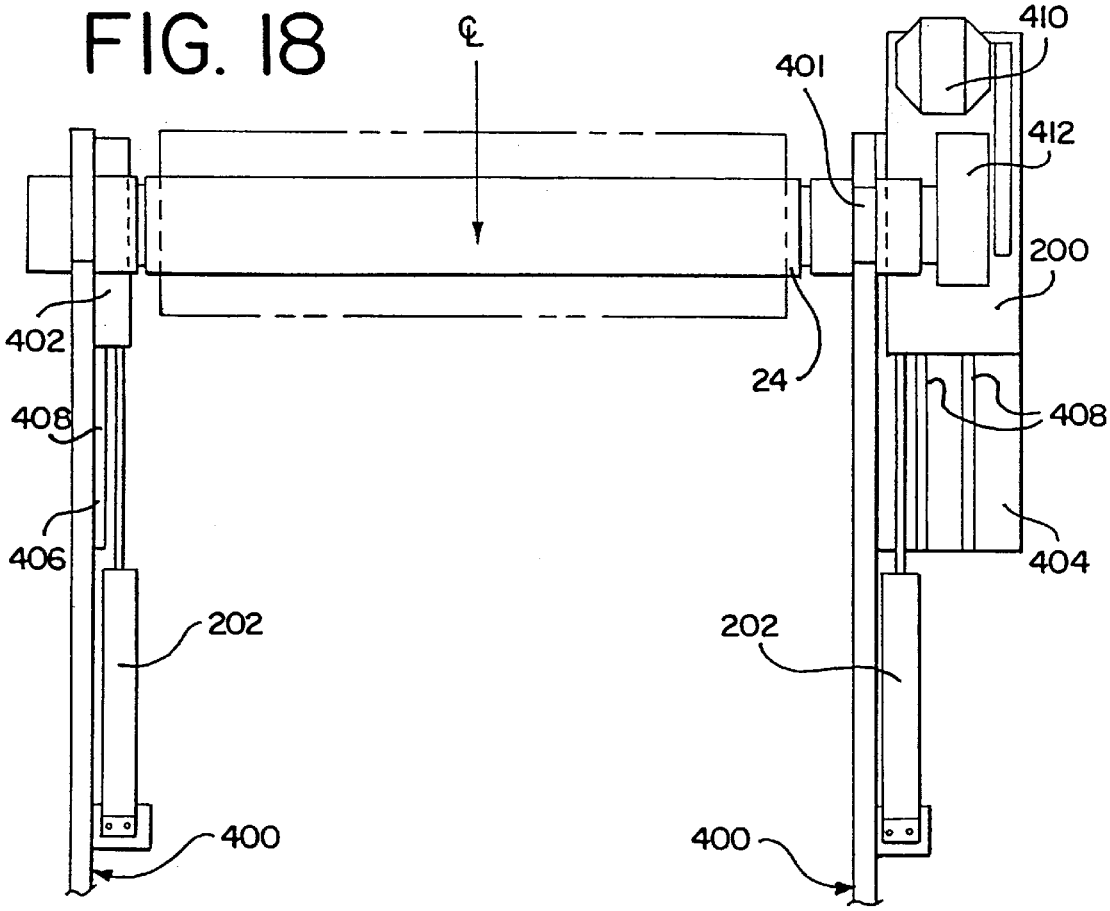
FIG. 18 is a partial top view of the reel spool and winding drum shown in FIG. 17 with only one set of carriages shown and without the slitting device applied thereto.

Referring to FIG. 18, only one set of carriages is shown for the purposes of simplicity, but it should be understood that the apparatus includes a duplicate pair of carriages and cylinders mounted opposite of the ones shown, i.e., in mirror image with a drive carriage positioned on the opposite outer side of the left hand rail (as viewed in FIG. 3), and a back carriage positioned on the inner side of the right hand rail (as viewed in FIG. 3). Both sets of carriages and cylinders are shown in FIG. 3. As shown in FIG. 17, each carriage member includes an upper portion 414 pivotally connected to a lower portion 416 with a hydraulic cylinder 418. In operation, the cylinder 418 is actuated to pivot the upper portion of the carriage members so as to receive the next reel spool as the other set of carriage members completes the winding cycle for the preceding roll. As the winding cycle is completed, the upper portion is pivotally lowered until the reel spool engages the rails and the reducer gear is extended to operably engage the reel spool. Meanwhile, after the roll and reel spool are removed from the rail and carriages, the carriages are pivoted downwardly by the cylinders, and cylinders 202 are extended so that the carriages may pass beneath the presently winding reel spool and be put in position to receive the next reel spool.

Figure 2:
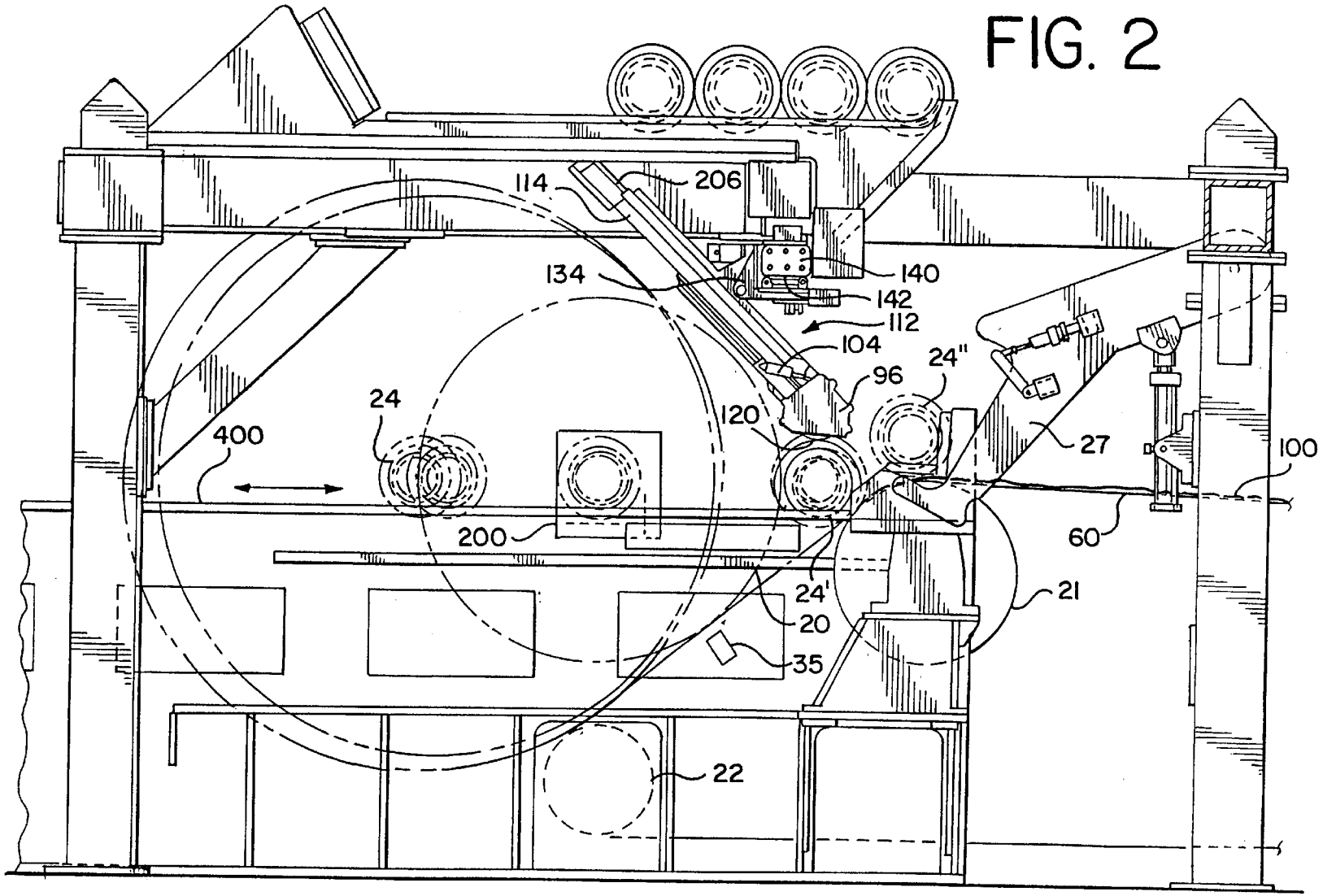
FIG. 2 is a side view of the slitting apparatus applied to a roll of sheet material web.
Figure 16:
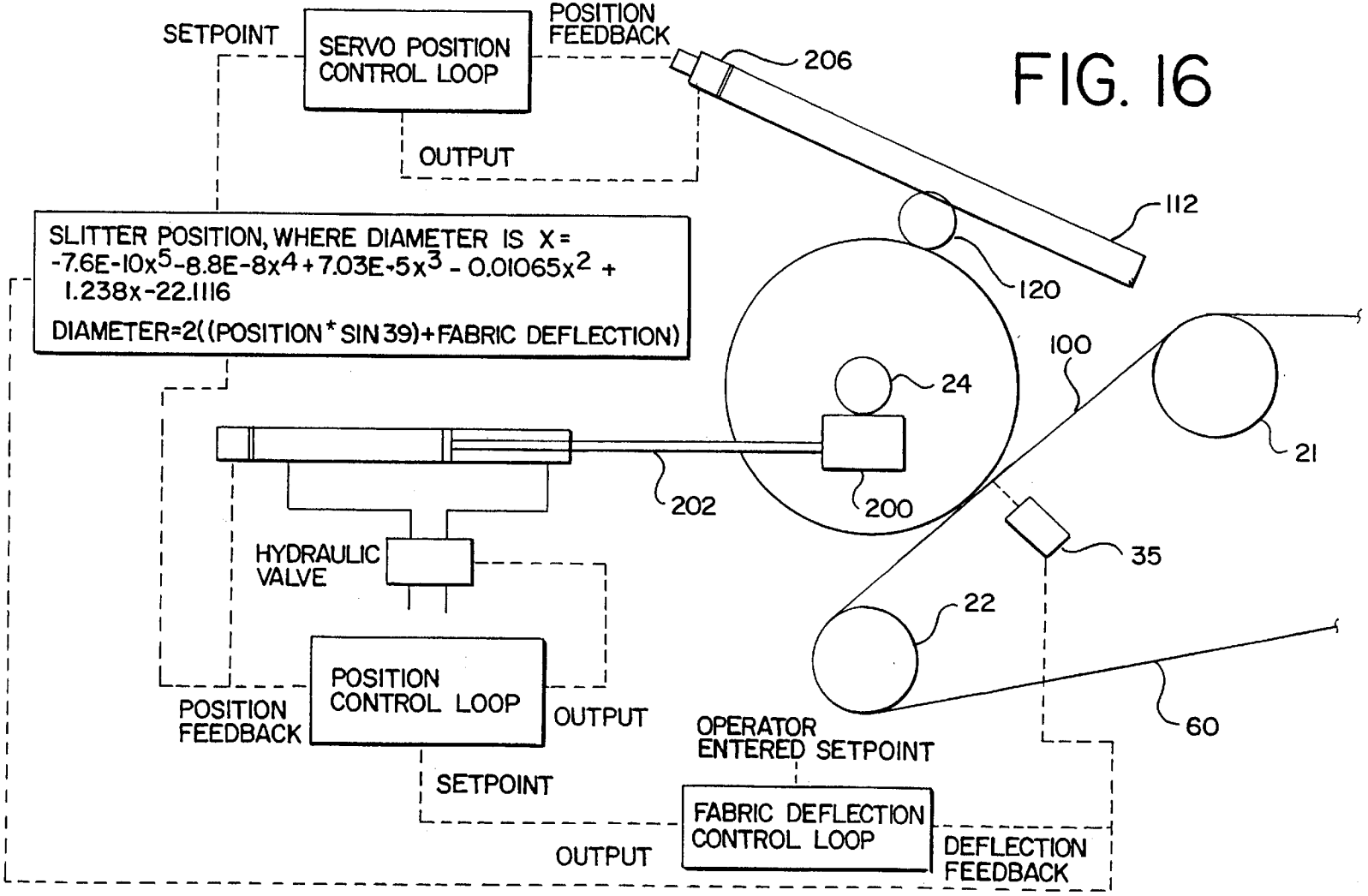
FIG. 16 is a schematic diagram of the control system for the slitting device.

Referring to FIGS. 2 and 16, control of the relative positions of the reel spool 24 and the transfer belt is suitably attained using a non-contacting sensing device 35 which is focused on the inside of the transfer belt, preferably at a point midway between the two winding drums as shown. The object is to minimize and control the pressure exerted by the parent roll against the sheet supported by the transfer belt as well as minimize the nip length created by the contact. The sensing device 35, such as a laser displacement sensor, detects changes in transfer belt deflection of as small as 0.005 inches. If the amount of deflection is outside a predetermined acceptable range, the sensor signals that the reel spool 24 of the parent roll be repositioned accordingly. It has been found that optimal winding operation for soft, high bulk tissue sheets is attained when the transfer belt deflection is maintained between about 2 to about 6 millimeters. Maintaining the transfer belt deflection within this range has been found to allow the parent roll and the transfer belt to operate with a relative speed differential without significant power transfer. This will allow control of the winding process to maintain substantially constant sheet properties throughout the parent roll.

Once the transfer belt deflection has been measured, a proportional only control loop maintains that deflection at a constant level. The output of this control is the setpoint for a hydraulic servo positioning control system for carriages 200, 402 supporting the building parent roll 20. When the transfer belt deflection exceeds the setpoint, the carriage position setpoint is increased, moving the carriage, 200, 402 away from the fabric 60 to return the deflection back to the setpoint. A specific hydraulic servo positioning system consists of Moog servo valves controlled by a Allen-Bradley Programmable Logic Controller ("PLC"), Part No. 5/40L, with a QB module and with Temposonic linear voltage transducers mounted on the rods of the hydraulic cylinders 202 to determine the position of the axis of the reel spool. The output from the deflection control loop is the input to two individual servo positioning systems on either side of the reel 24. Each system can then control the hydraulic cylinders 202, keeping the two sides of the reel parallel. Preferably, a protection system stops the operation if the parallelism is lost, but it is not necessary to have an active system to keep the two sides parallel.

Figure 4:
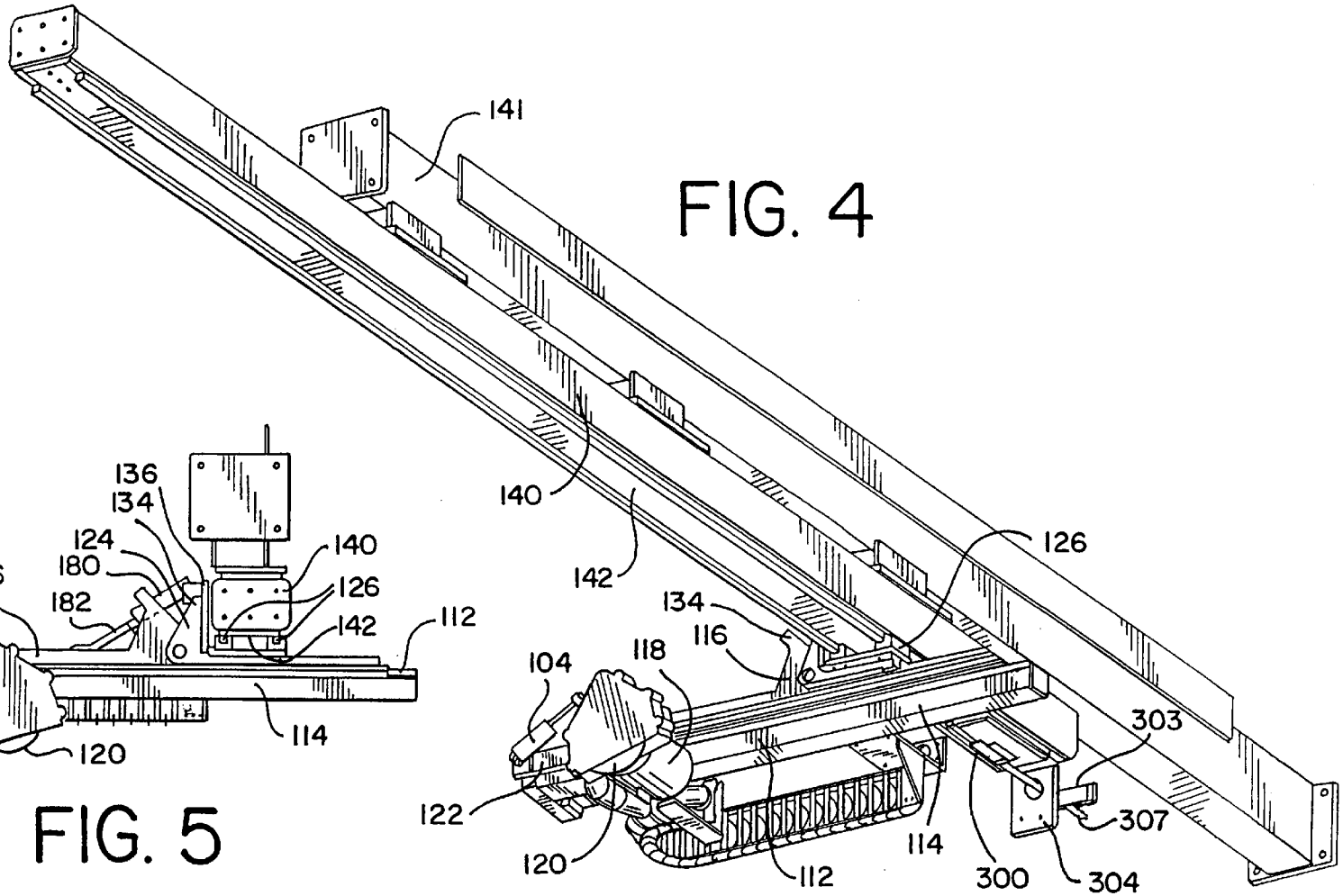
FIG. 4 is a perspective view of a slitting device including a track member mounted on a support member.
Figure 5:
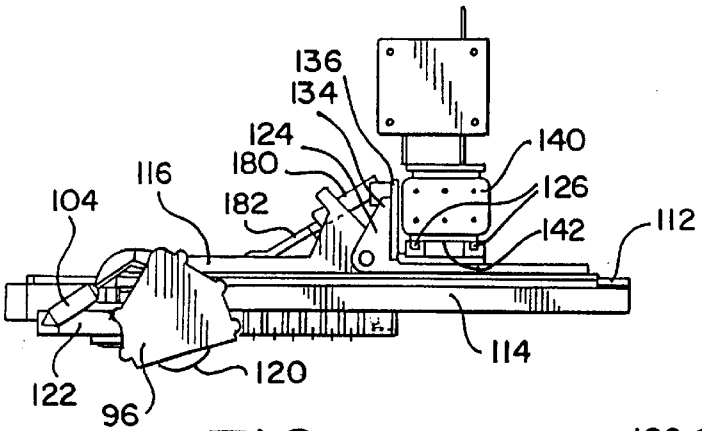
FIG. 5 is a side view of the slitting device with the track member in an upright horizontal position.
Figure 6:
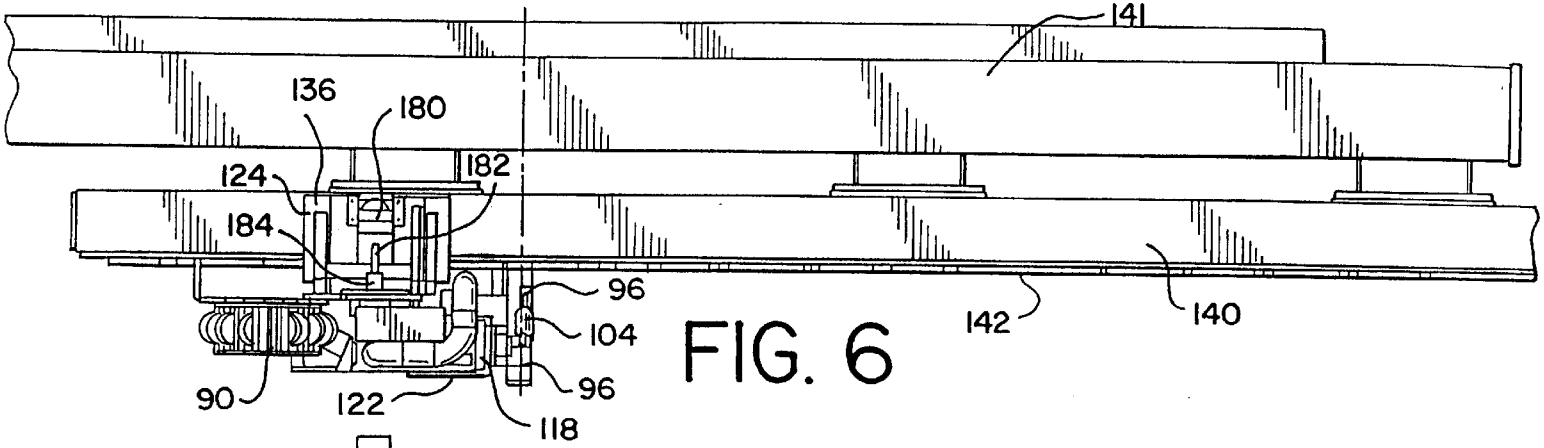
FIG. 6 is a front view of the slitting device shown in FIG. 5.
Figure 7:
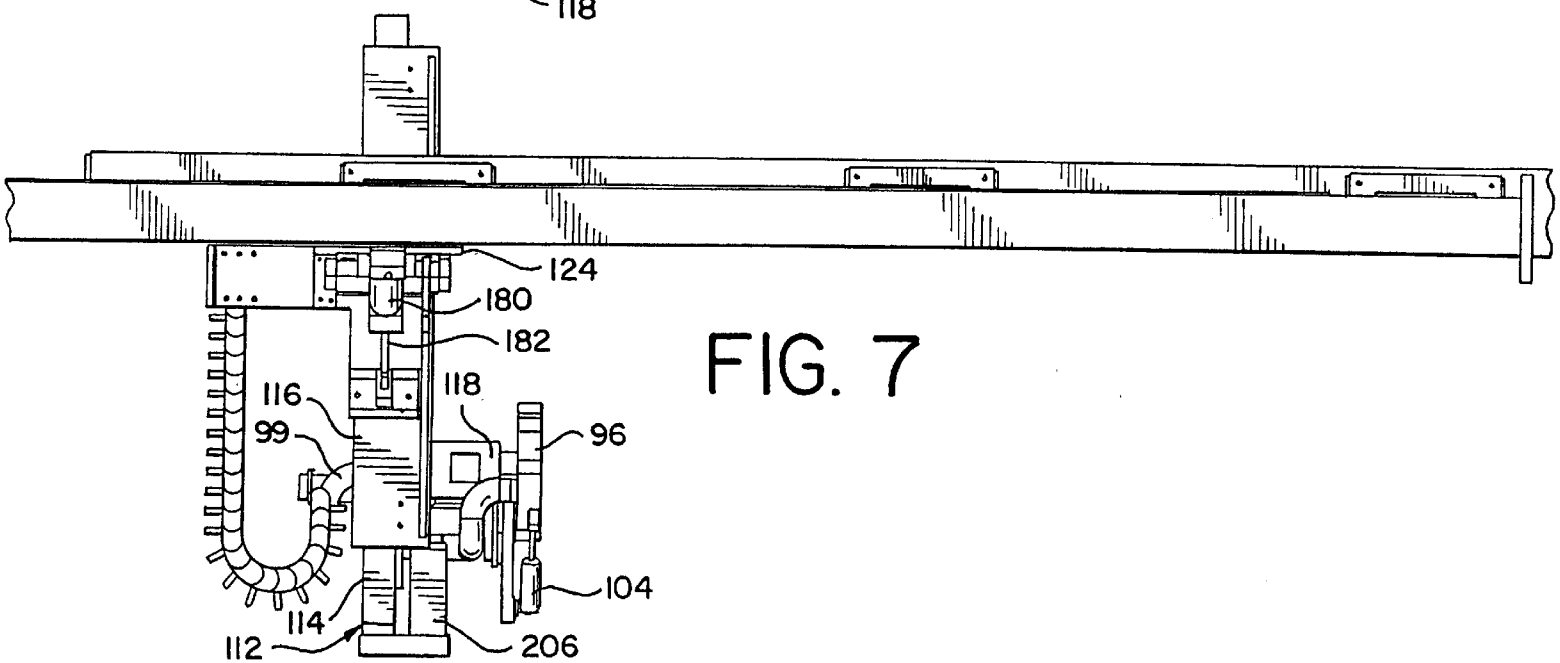
FIG. 7 is a top view of the slitting device shown in FIG. 5.
Figure 8:
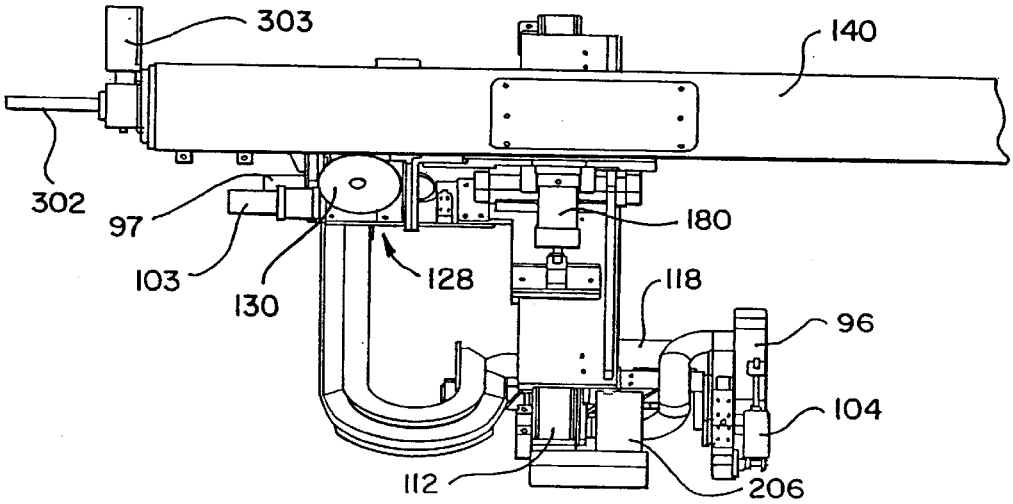
FIG. 8 is a top view of the slitting device with the track member in an angled operating position.

Referring now to FIGS. 2–10, and 13, one embodiment of the slitting apparatus is shown as including a slitting device having track member 112 with an elongated housing 114, an elongated screw 204 rotatably mounted in said housing, as shown in FIG. 13, and a slide member 208 slideably mounted to the housing. As shown in FIGS. 6–8, a servo drive motor 206 is mounted adjacent one end of the housing and is operably connected to an end of the screw, which extends from an end of the housing, with a belt, or like device. A commercially available track member is the STAR Linear Module MKK 25-110 available from Star Linear Systems in Charlotte, N.C.

Referring to FIGS. 4 and 7, a motor 118 and slitting member 120, preferably a rotary saw-toothed blade, are mounted to a support bracket 122 which is bolted to the slide member 208. The slitting member 120 is rotatably connected to the motor 118, which is mounted to the bottom of the support bracket. Use of a saw toothed blade avoids the need to sharpen the blade, which is important for various safety reasons. A commercially available saw blade suitable for use is the 1 inch inner diameter, 12 inch outer diameter tool steel blade sold by Heinemann Saw Co. as Part No. Schedule 456-A. Preferably, the saw blade rotates clockwise, or in the same direction as the travel of the fabric and sheet material web, and a greater speed, preferably at about a 2:1 ratio. In a preferred embodiment, the sheet speed is about 5,000 ft/min, while the blade rim speed is about 11,300 ft/min.

Alternatively, the slitting member can be configured as one of a stationary moveable knife blade, a water jet, a laser or any other known and conventional slitting device.

Figure 10:
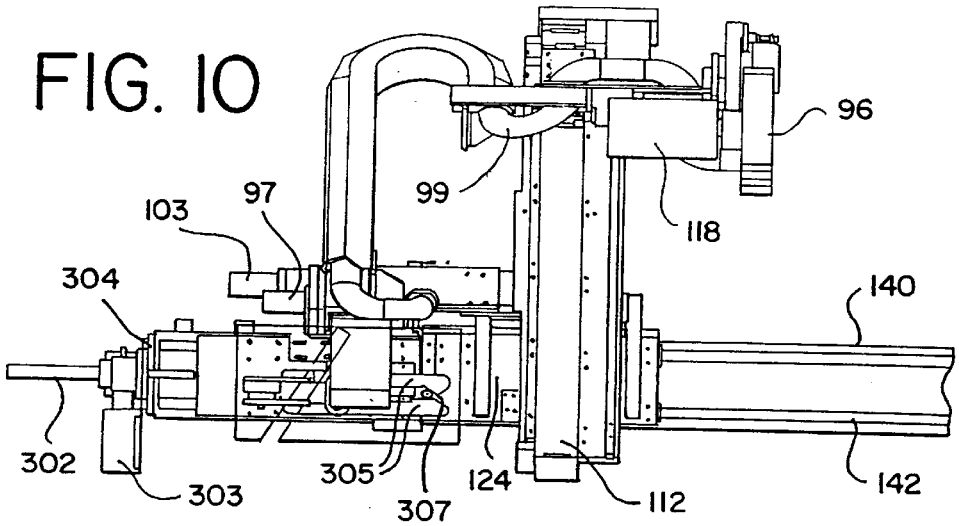
FIG. 10 is a bottom view of the slitting device shown in FIG. 8.
Figure 9:
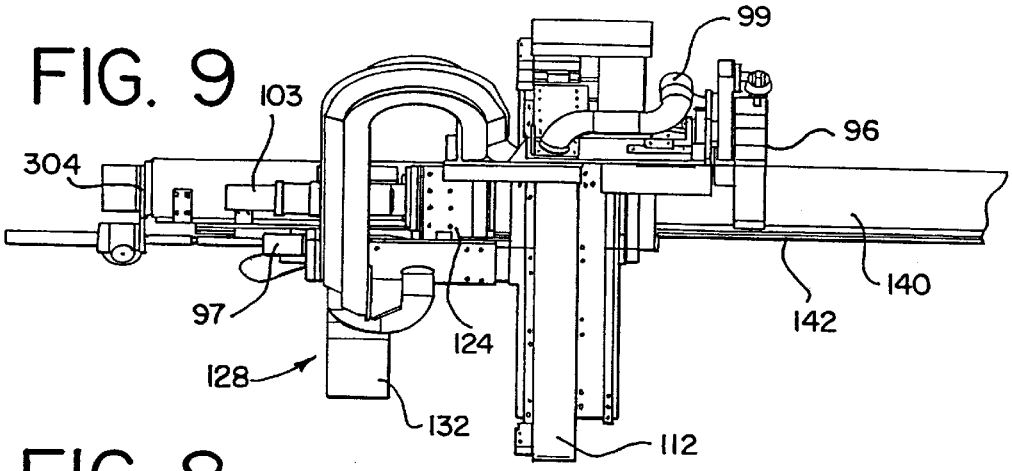
FIG. 9 is a front view of the slitting device shown in FIG. 8.

As shown in FIG. 11, a guard 96 is disposed around the saw blade 92 to shield the blade from the operator. A vacuum can be applied to the guard 96, which forms a housing around the blade, to suction away the dust created by the slitting operation. As shown in FIGS. 8–10, a conventional vacuum is attached at port 97, which is connected to the guard 96 with conduit 99. As shown in FIG. 12, a plate member 98 having a V-shaped mouth 102 is mounted to the bottom of the guard to increase the air velocity of the vacuum applied adjacent the blade. The mouth 102 is tapered so that it has a larger opening at the trailing edge of the mouth which allows for a relatively large amount of dust and fiber to pass through the mouth when the slitting member is actuated to make a plunge cut in the roll. A lubrication mist can also be applied to keep the blade clean.

As shown in FIGS. 5, 8 and 11, the guard 96, or housing, is pivotally connected to the support bracket 122. A pneumatic cylinder 104, preferably a gas spring, or air cylinder, is rotatably connected to the guard at one end and the support bracket at the other end. In operation, the cylinder 104 is actuated to rotate the guard 96 about a pivot axis so as to change the angular position of the guard in relation to the building roll.

As illustrated in FIGS. 4–10, a support bracket 116 is mounted to the top of the track member and is pivotally attached to a carriage 124 at a horizontal pivot axis. The carriage 124 is moveably supported on a bottom of a cross member 140, preferably mounted to an overhead support structure or beam 141. It should be understood by one of skill in the art that the carriage could also be moveably mounted directly to the support structure. As best shown in FIGS. 4, 9 and 10, the cross member 140 includes a track 142 running along the length of the bottom surface of the cross member. Referring to FIG. 5, a pair of guides 126, or linear bearings, interface between the carriage 124 and track 142. A drive device 128, preferably including a drive motor 132 and wheel 130, extends outwardly from the carriage and engages a front surface of the cross member. It should be understood that the drive device, and wheel, could also be positioned to operably engage the underlying track, or the rear surface of the cross member. In operation, the motor 132 is actuated to drive the wheel 130 and thereby propel the carriage 124 along the length of the cross member. Preferably, the motor is air operated and is operably connected with an appropriate air supply at port 103. In this way, the carriage, and attached slitting member, can be moved laterally to a desired slitting position above the roll, or can be brought to the side of the machine where the operator or mechanic can service the slitting device, or change the saw blade thereon. Alternatively, it should be understood that the carriage can be moved along the track in any number of conventional and well known ways, such as by a chain drives, belts, gears and like devices.

Preferably, when being moved laterally from a centered slitting position to a side maintenance position adjacent the operator, the track 112 is pivoted into the upright horizontal position so as not to interfere or collide with the overlying support structure. In addition, the slitting member 120 is thereby positioned away from the underlying roll or reel spool so as to avoid any inadvertent contact and attendant damage. Proximity switches are installed on the slitting device and/or track system and must be activated in order to permit further lateral travel of the slitting device along the track.

When positioned at the preferred slitting or operating position overlying the roll, a further lateral adjustment mechanism includes a trolley member 300 mounted on a bottom of the cross member and connected to the carriage as shown in FIGS. 8–10. Referring to FIG. 10, the trolley member 300 includes a pair of pneumatically controller fingers 305 which are actuated to engage a pin 307 extending from the carriage 124. A screw jack 302 is rotatably connected to a bracket 304 extending downwardly from the cross member and threadably engages the trolley 300. A motor 303 is operably connected to the screw jack and can be controlled to rotate the screw and thereby move the trolley and attached carriage linearly along the track. Alternatively, the screw jack can be manually operated and manipulated to move the carriage laterally along the overlying track. Preferably, the screw jack 302 provides the trolley 300, and attached carriage, with ±2 inches of linear travel from the center line of the desired slitting position. The motor and screw can be manipulated so as to maintain with great accuracy the lateral position of the slit within the roll.

As shown in FIGS. 2 and 5, a stop member 134 extends upwardly from bracket member 116 adjacent the horizontal pivot axis. A pneumatic cylinder 180 is pivotally connected to a plate member 136 extending upwardly from a forward portion of the carriage. A piston rod 182 extends downwardly and forwardly from the cylinder and includes an end 184 pivotally connected to the bracket member 116. Preferably, the pneumatic cylinder is a gas spring, or air cylinder, which is less likely to leak fluids or oils, although it should be understood that hydraulic cylinders would also work. When retracted, the cylinder pivots the bracket and attached track about the pivot axis so as to position the track in a transverse and spaced apart tangential relationship with the roll below. Preferably, the track is maintained at a relatively constant distance from the surface of the roll as the roll increases in diameter and moves away from the winding drum. In operation, the stop member 134 engages the plate member 136 to prevent the track member from pivoting too far towards the roll of sheet material web, and more specifically the reel spool, underlying the slitting member. In addition, proximity switches (not shown) can be installed on the track and carriage. In operation, the proximity switches must be triggered either to signal that the track is in the upright horizontal position and is therefore ready for lateral travel along the cross member, or to signal that the track is in the angled operating position and is therefore ready for operation.

In operation, and as diagrammed in FIG. 16 and shown in FIGS. 2–3 and 17–18, the pneumatic cylinder 180 is retracted to pivot the track from an upright horizontal position to the preferred tangential operational position, and the proximity switches are triggered so as to allow the slitting operation to begin. Meanwhile, the sheet 100 is transferred to the reel spool 24 as explained above and is rotatably deposited thereon. After a predetermined number of layers of sheet material web have been applied to the roll, or a predetermined thickness or diameter of the roll has been reached, usually in the range of about 1–2 inches of material, a digital servo controller receives a signal to actuate the servo drive motor 206 which rotates the screw 194 and thereby moves the slide member and attached support bracket 122 and slitting member toward the reel spool 24 to make a plunge cut in the roll. The controller is then signaled to actuate the servo drive motor 206 to move the slitting member 120 away from the roll until a predetermined penetration of the saw blade is reached within the roll. During these operations, only the slitting member, or blade, contacts the roll; neither the control system nor the track member contacts the outer surface of the roll. Similarly, the blade is preferably configured without an attached guide or pressure roller, which are typically used to control the depth of penetration. Indeed, the preferred plunge cut may not be possible with such a configuration, or in any other embodiment where the blade is mechanically linked to a roller or similar device contacting the outer surface of the roll. Accordingly and preferably, the only other contact with the roll, besides the blade, is at the nip where the fabric first applies the sheet material web to the roll.

As the roll 20 builds, the reel spool 24 moves away from the winding drum 21 as explained above. As the reel spool moves, corresponding to the parent roll building in diameter and size, an output signal from the position sensors (not shown) on the hydraulic cylinders 202, which directly corresponds to the position of the axis of the reel spool, serves as the setpoint for the servo position control loop and the servo controller operably connected to the servo drive motor and track. A suitable servo controller is the 1394 controller module available from Allen-Bradley. The servo position drive on the track interfaces with the PLC controller with a 4 to 20 milliamp linear signal, with 4 milliamps corresponding to the minimum zero displacement of the slitting member along the track at its starting position and 20 milliamps corresponding to a maximum 60 inch displacement of the slitting member. In response to the signal from the PLC controller corresponding to the position of the reel spool, the controller signals the motor to move the slide member so as to maintain a predetermined penetration of the slitting member within the roll. Alternatively, the radius or thickness of the roll 20 can be determined by direct measurement, and can serve as an input for the controller.

In the preferred embodiment, the diameter of the roll is known by means of the relative position of the reel spool shaft from it initial starting position and the transfer belt deflection. As just described, the PLC controller is programmed to receive an input corresponding to the position of the hydraulic cylinders, which determines the relative position of the reel spool shaft, and then signals the servo drive to actuate the motor and track to move the slitting member within the track to maintain the desired penetration. A computer can be programmed and used to interface with the controllers, and thereby adjust the desired depth of penetration using the same control concepts.

Preferably, when the roll reaches about one half of its final size, or about 68 inches for a 140 inch roll, the slitting member 120 has moved upwardly within the track 112 so that the mouth 102 of the guard is no longer at an approximate tangent to the roll, which is the preferred orientation. At this point, the PLC signals the cylinder 104 to rotate the guard and thereby alter the exposure of the blade for the remainder of the slitting operation Proximity switches are installed in the guard 96, and must be triggered by the rotation of the guard in order for the upward and downward movement of the slitting member on the track to continue.

Preferably, the track 112 is pivoted into an operational position at an angle of about 43.6 degrees from the horizontal position such that the track forms a path parallel to and spaced apart at a relatively constant distance from an approximate tangent of the outer surface of the roll as it builds in size. In this way, the slitting member 120 need only be translated within the track 112 as it continuously slits the building roll. However, it should be understood that the track could be simultaneously pivoted as the slitting member is translated, or that both motions be actuated together or alone, so as to maintain the proper depth of penetration of the slitting member within the roll.

As illustrated in the FIG. 3, an electrical harness 190 electrically connects an operator station 192 with the carriage 124 and attached slitting device. In this way, the servo controller and motor are connected with the reel spool control system, so as to control the movement of the support bracket along the track. The retraction of the pneumatic cylinder and the movement of the carriage on the cross member track can similarly be controlled.

Figure 15:
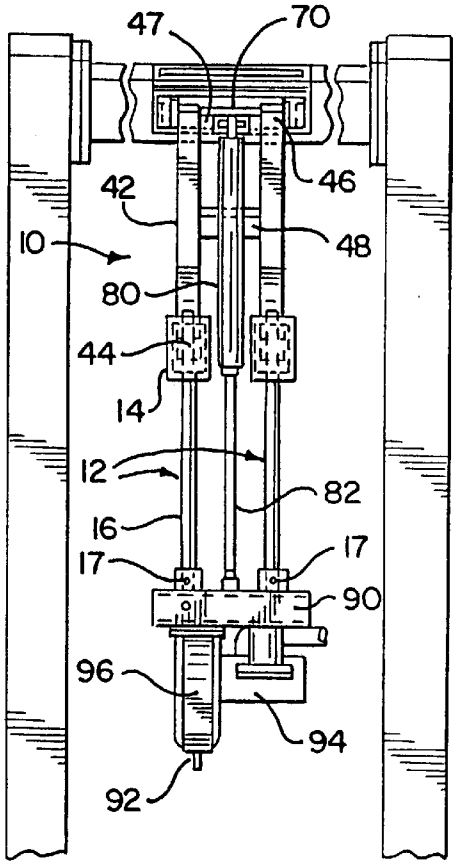
FIG. 15 is a rear view of the slitting apparatus of FIG. 14.
Figure 14:
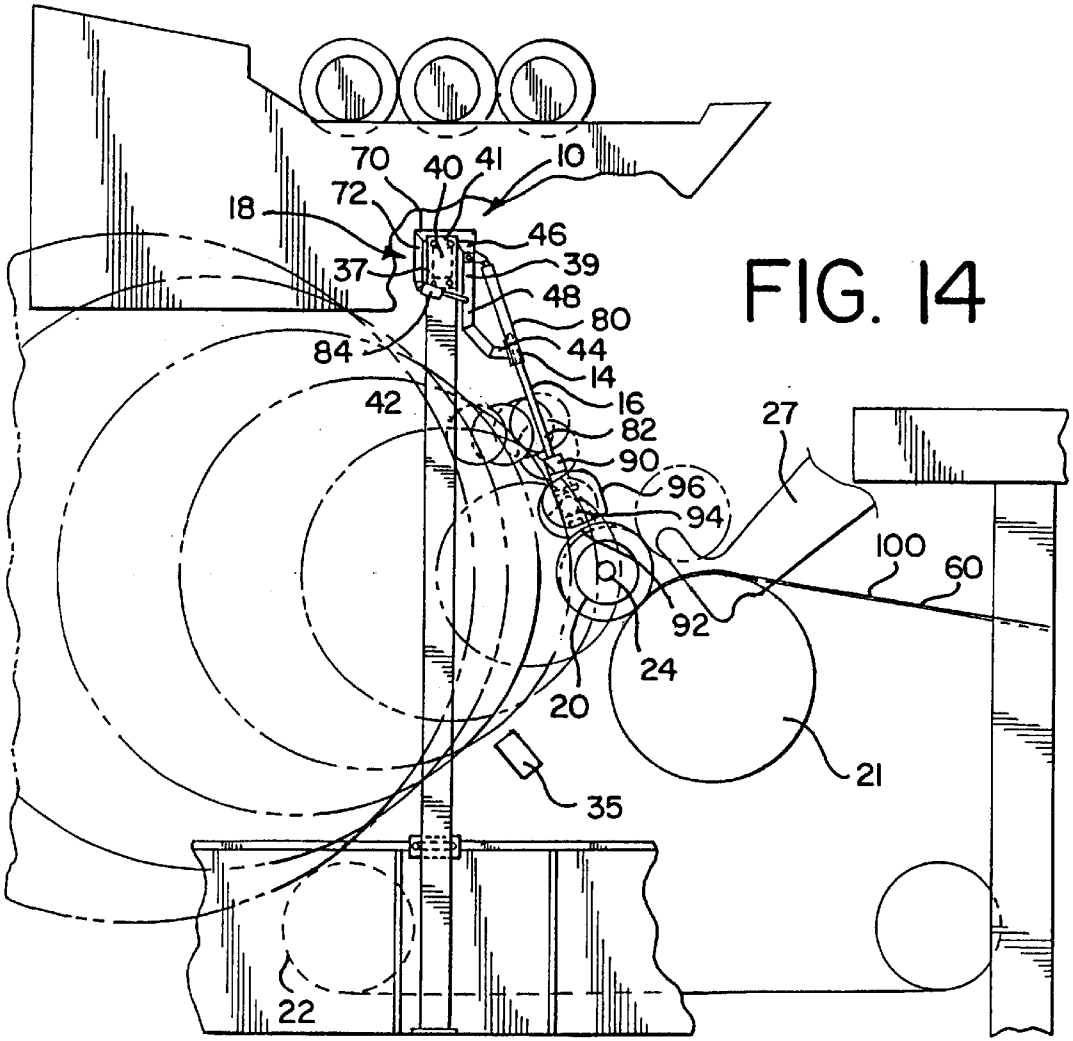
FIG. 14 is a side view of an alternative embodiment of the slitting apparatus.

Referring to FIGS. 14–15, an alternative embodiment of the slitting apparatus 10 has a slitting device 18 mounted to a support member 40. The slitting device includes a pair of tracks 12 having a guide member 14 and a slide member 16 slideably received in the guide member. Each guide member 14 is mounted to an end 44 of a downwardly extending arm member 42, which has an opposite end 46 pivotally connected to a carriage 70. The arm members 42 are laterally spaced apart and connected with a cross member 48. The carriage 70 is either mounted to or moveably supported on the support member 40. The support member is preferably configured as a cross member supported on opposite ends thereof over the path of the sheet material web and underlying roll of sheet material. The arm portions 42 extend downwardly from the carriage along a rear surface 39 of the cross member.

As shown in FIGS. 14 and 15, a hydraulic cylinder 80 is pivotally attached to the carriage 70 about a horizontal pivot axis. A piston rod 82 extends downwardly from the cylinder and is attached to a support bracket 90. A lower end 17 of each slide member is also attached to the support bracket. A slitting member 92, preferably a rotary saw-toothed blade, is rotatably connected to a motor 94, which is mounted to the bottom of the support bracket. Alternatively, the slitting member can be configured as one of a stationary moveable knife blade, a water jet, a laser or any other known and conventional slitting device.

Preferably, as described above, a guard 96 is disposed around the saw blade 92 to shield the blade from the operator. Preferably, a vacuum is applied to the guard, which forms a housing around the blade, to suction away the dust created by the slitting operation. A lubrication mist can also be applied to keep the blade clean.

As shown in FIG. 15, a second hydraulic cylinder 84 is pivotally attached to a forward portion 72 of the carriage at a horizontal pivot axis. The forward portion 72 extends downwardly adjacent a forward surface 37 of the cross member. The cylinder 84 extends rearwardly from the forward portion of the carriage and is pivotally attached to an approximate midpoint of the lower cross member 48, which interconnects the arm members.

In operation, the cylinders 80, 84 are extended to engage the roll with the slitting member. Preferably, a plunge cut is made to slit the initial layers of sheet material web already deposited on the roll. As the roll 20 builds, the reel spool 24 moves away from the winding drum 21 as explained above, and a controller retracts cylinder 80 so as to maintain a predetermined penetration of the saw blade within the roll as it builds in size. In particular, the cylinder 80 retracts the piston rod 82 so as to translate the slide members within the guide members in a substantially linear direction so as to thereby move the slitting member to maintain the predetermined depth of penetration. As the roll continues to build, and as the reel spool 24 continues to move away from the winding drum, the controller is further signaled to actuate the second cylinder 84 to pivot the arm members 42 and attached slitting member about the horizontal pivot axis. During this pivotal movement, the slide members are preferably maintained at a fixed position relative to the guide member, so as to maintain the predetermined depth of penetration. Although the steps of actuation or retraction of the first and second cylinders have been described as being consecutive in operation, it should be understood that the cylinders could be simultaneously actuated so as to simultaneously pivot and translate the slitting member so as to maintain the desired predetermined depth of the slitting member within the roll. The hydraulic cylinders are controlled in the same manner is the cylinders in the previous embodiment with position control loops.

The slitting apparatus and method of slitting provides significant advantages. First, the invention provides for supporting the web on a fabric between the dryer and the winding drum, which allows the manufacturer to do away with open draws. Accordingly, sheet breaks and the like are reduced, while simultaneously allowing for the manufacture of a softer, more desirable sheet material product. In addition, the invention eliminates the need for wet slitting which helps to preserve the throughdrying fabric, improves the control of sheet web and provides a more uniform web. Moreover, the lateral position of the slitting apparatus can be easily adjusted and changed, either to vary the position of the slit or to move the slitting device to the operator for service.

Furthermore, the invention allows for the web to be slit on the roll, such that the web being slit is supported by underlying layers of web which results in a cleaner, improved cut. Moreover, since each layer is slit after it is applied to the roll, the invention eliminates the problem of interweaving between the separate strips of sheet material web. As such, the finished rolls can be easily separated and removed from the reel spool.

Additionally, the preferred invention includes a single track overlying the roll, with the slitting device moveably mounted on the track member. By using a single track, as opposed to a pair of tracks positioned on opposite sides of the roll, the apparatus is greatly simplified and allows for the track and slitting device to be moved easily to the desired cutting position. Moreover, the single track avoids the possibility of binding between opposite side supports, and reduces the number of parts which must be installed and maintained.

The invention also provides a slitting device whose position is not linked to or controlled by the outer surface of the building roll. Accordingly, the slitting member can be easily programmed to make a plunge cut after a predetermined depth is reached on the building roll, but without compressing the roll adjacent the cut. The programmable control system also provides for the ability to make a plunge cut, but without a complicated and expensive mechanism. Moreover, the depth of penetration of the slitting member can be controlled without a guide roller contacting the outer surface of the roll which is important when slitting sheets of tissue, which have relatively low densities and cannot adequately support a guide roller or like stop device due to their relative inability to resist compressive forces. By providing a control system that does not key off of the surface of the roll, or otherwise contact it, but rather programmably links the reel spool and slitter member, the sheet material web is less likely to be damaged and a more reliable depth of penetration is maintained. That is because it is only the slitting member, or blade component of the slitting device which contacts the roll, not the track, control system or carriage, or any type of guide or pressure roller attached to the blade or applied separately to the roll.

Although the present invention has been described with reference to preferred embodiments, those skilled in the art will recognize that changes may be made in form and detail without departing from the spirit and scope of the invention. As such, it is intended that the foregoing detailed description be regarded as illustrative rather than limiting and that it is the appended claims, including all equivalents thereof which are intended to define the scope of the invention.

We claim:

1. An apparatus for penetrating a sheet material web, said apparatus comprising:

a reel spool rotatable about a first axis of rotation and adapted to support a roll of the sheet material web;

a support structure positioned adjacent to said reel spool;

a slitting, device moveably mounted to said support structure, wherein said slitting device is moveable relative to said reel spool toward and away therefrom, said slitting device comprising a guard housing having a mouth and a slitting member rotatably mounted within said guard housing about a second axis of rotation, wherein said slitting member comprises a peripheral edge, wherein at least a portion of said peripheral edge extends from said guard housing through said mouth of said guard housing, wherein said at least said portion of said peripheral edge has an exposed length and is adapted to penetrate said roll of sheet material web as is it is wound onto said reel spool, wherein said guard housing is pivotable about a pivot axis, wherein the length of said at least said peripheral edge portion that is exposed remains constant as said guard housing and said mouth are pivoted about said pivot axis, and wherein said pivot axis and said second axis of rotation are coaxial;

an actuator being rotatably connected to said guard housing about a first axis at one end and rotatably connected to said support structure about a second axis at the other end wherein said first and second axis being parallel to said pivot axis and offset from said pivot axis such that said actuator is operable to pivot said guard housing about said pivot axis; and a power source operably connected to said slitting member and adapted to rotate said slitting member about said second axis of rotation.

2. The apparatus of claim 1 further comprising a sensor adapted to send a signal in response to an increase in the size of the roll of sheet material web, and wherein said guard is adapted to pivot about said pivot axis in response to said signal.

3. The apparatus of claim 1 wherein said support structure comprises a track, and wherein said slitting device is moveable along said track.

4. The apparatus of claim 3 wherein said support structure further comprises a frame, wherein said track is pivotally mounted to said frame.

5. The apparatus of claim 1 wherein the mouth of said guard housing forms a tapered opening.

6. The apparatus of claim 1 wherein said actuator comprises a pneumatic cylinder.

7. The apparatus of claim 1 further comprising a vacuum applied to said guard housing.

8. A method for penetrating a sheet material web comprising:

depositing a sheet material web onto a rotating reel spool to form a roll of sheet material web characterized by a diameter;

providing a support structure positioned adjacent to said reel spool;

providing a slitting device comprising a guard housing having a mouth and a slitting member disposed within said guard housing, said slitting member comprising at least a portion extending from said guard housing through said mouth of said guard housing;

penetrating said sheet material web with said at least said portion of said slitting member extending from said guard housing as said sheet material web is wound onto said reel spool;

rotating said slitting device about an axis of rotation wherein a pivot axis and said axis of rotation are coaxial;

providing an actuator being rotatably connected to said guard housing about a first axis at one end and rotatably connected to said support structure about a second axis at the other end wherein said first and second axis being parallel to said pivot axis and offset from said pivot axis; and pivoting said guard housing about said pivot axis as said diameter of said roll increases.

9. The method of claim 8 further comprising moving said slitting device away from said reel spool as said diameter of said roll increases.

10. The method of claim 8 further comprising sensing an increase in said diameter of said roll of sheet material with a sensor, sending a signal from said sensor in response to said increase in said diameter of said sheet material roll, and pivoting said guard housing about said pivot axis in response to said signal.

11. The method of claim 8 further comprising connecting said slitting device to a support structure, wherein said support structure comprises a track, and further comprising moving said slitting device along said track.

12. The method of claim 11 wherein said support structure further comprises a frame, wherein said track is pivotally mounted to said frame.

13. The method of claim 8 wherein the mouth of said guard housing forms a tapered opening.

14. The method of claim 8 wherein said actuator comprises a pneumatic cylinder.

15. The method of claim 8 further comprising applying a vacuum to said guard housing.

16. The method of claim 8 wherein said pivoting said guard housing about said pivot axis as said diameter of said roll increases comprises intermittently pivoting said guard housing as said diameter of said roll increases, and wherein said guard housing is intermittently pivoted at least once as said diameter of said roll increases.

17. A method for penetrating a sheet material web comprising:

depositing a sheet material web onto a rotating reel spool to form a roll of sheet material web characterized by a diameter;

providing a support structure positioned adjacent to said reel spool;

providing a slitting device comprising a guard housing having a mouth and a slitting member disposed within said guard housing, said slitting member comprising a peripheral edge and wherein at least a portion of said peripheral edge extends from said guard housing through said mouth of said guard housing, wherein said at least said portion of said peripheral edge extending from said guard housing has an exposed length, and wherein the length of said at least said portion of said peripheral edge that is exposed remains constant as said guard housing is pivoted about a pivot axis;

penetrating said sheet material web with said at least said portion of said slitting member extending from said guard housing as said sheet material web is wound onto said reel spool;

rotating said slitting device about an axis of rotation wherein said pivot axis and said axis of rotation are coaxial;

providing an actuator being rotatably connected to said guard housing about a first axis at one end and rotatably connected to said support structure about a second axis at the other end wherein said first and second axis being parallel to said pivot axis and offset from said pivot axis; and pivoting said guard housing about said pivot axis as said diameter of said roll increases.

18. A method for penetrating a sheet material web comprising:

depositing a sheet material web onto a rotating reel spool to form a roll of sheet material web characterized by a diameter;

providing a support structure positioned adjacent to said reel spool;

providing a slitting device comprising a guard housing having a mouth and a slitting member rotatably mounted within said guard housing about a pivot axis, said slitting member comprising a peripheral edge and wherein at least a portion of said peripheral edge extends from said guard housing through said mouth of said guard housing, wherein said at least said portion of said peripheral edge extending from said guard housing has an exposed length;

rotating said slitting member about said pivot axis;

penetrating said sheet material web with said at least said portion of said rotating slitting member extending from said guard housing;

providing an actuator being rotatably connected to said guard housing about a first axis at one end and rotatably connected to said support structure about a second axis at the other end wherein said first and second axis being parallel to said pivot axis and offset from said pivot axis; and pivoting said guard housing about said pivot axis, wherein the length of said at least said portion of said peripheral edge that is exposed remains constant as said guard housing is pivoted about said pivot axis.

19. The method of claim 18 further comprising connecting said slitting device to said support structure.

20. The method of claim 19 wherein said slitting device is moveably connected to said support structure, and further comprising moving said slitting device relative to said support structure.

21. The method of claim 18 wherein the mouth of said guard housing forms a tapered opening.

22. The method of claim 18 wherein said actuator comprises a pneumatic cylinder.

23. The method of claim 18 further comprising applying a vacuum to said guard housing.

* * * * *